US011138842B2

(12) United States Patent
Moore et al.

(10) Patent No.: US 11,138,842 B2
(45) Date of Patent: Oct. 5, 2021

(54) SYSTEM FOR DETECTING THE PRESENCE OF AN OBJECT TO BE PROTECTED IN A LOW-LIGHT ENVIRONMENT

(71) Applicant: Matrix Design Group LLC, Newburgh, IN (US)

(72) Inventors: Timothy R. Moore, Newburgh, IN (US); Ryan Jones, Newburgh, IN (US); Joel Nichols, Columbia City, IN (US)

(73) Assignee: Matrix Design Group LLC, Newburgh, IN (US)

( * ) Notice: Subject to any disclaimer, the term of this patent is extended or adjusted under 35 U.S.C. 154(b) by 0 days.

(21) Appl. No.: 16/820,186

(22) Filed: Mar. 16, 2020

(65) Prior Publication Data

US 2020/0219369 A1 Jul. 9, 2020

Related U.S. Application Data

(62) Division of application No. 16/129,945, filed on Sep. 13, 2018, now Pat. No. 10,614,677.

(Continued)

(51) Int. Cl.

| | |
|---|---|
| ***G08B 5/36*** | (2006.01) |
| ***F21V 15/01*** | (2006.01) |
| ***F21V 5/00*** | (2018.01) |
| ***G08B 13/196*** | (2006.01) |
| ***F21V 23/00*** | (2015.01) |
| ***F21W 131/40*** | (2006.01) |

(Continued)

(52) U.S. Cl.

CPC ..... *G08B 5/36* (2013.01); *F21V 5/008* (2013.01); *F21V 15/01* (2013.01); *F21V 23/006* (2013.01); *G08B 13/19695* (2013.01); *F21W 2131/40* (2013.01); *F21Y 2113/00* (2013.01); *F21Y 2113/13* (2016.08); *F21Y 2115/10* (2016.08)

(58) Field of Classification Search

None

See application file for complete search history.

(56) References Cited

U.S. PATENT DOCUMENTS 5,048,095 A 9/1991 Bhanu et al.
7,855,755 B2 * 12/2010 Weller ..... B60R 1/02 349/11

(Continued)

*Primary Examiner* — Clifford Hilaire

(74) *Attorney, Agent, or Firm* — Martin IP Law Group; C. Richard Martin

(57) ABSTRACT

A system for detecting patterns on objects having reflective or high visibility colored material thereon. The system includes a lighting unit that includes a main housing having a front opening and a cavity, a first visual lighting assembly positioned within the cavity of the main housing that emits light in the visible spectrum, and a second ultraviolet lighting assembly positioned a fixed distance from the first visual lighting assembly within the cavity of the main housing that emits light in the ultraviolet spectrum, a camera having a field of view within which the system is configured to detect patterns of reflective or high visibility colored material on one or more objects, a warning device to alert the operator when a marked object enters the camera's field of view. A controller/processor is programmed to detect when a pattern of reflective or high visibility colored material enters the camera's field of view. A variety of patterns can be used, and the controller can be programmed to associated each pattern with a specific object.

6 Claims, 9 Drawing Sheets

Related U.S. Application Data

(60) Provisional application No. 62/557,793, filed on Sep. 13, 2017.

(51) Int. Cl.
*F21Y 115/10* (2016.01)
*F21Y 113/00* (2016.01)
*F21Y 113/13* (2016.01)

(56) References Cited

U.S. PATENT DOCUMENTS

| | | | | |
|---|---|---|---|---|
| 10,076,993 | B2 | 9/2018 | Nichols | |
| 2002/0151992 | A1 | 10/2002 | Hoffberg et al. | |
| 2003/0174504 | A1 | 9/2003 | Tamaoki | |
| 2007/0120137 | A1 | 5/2007 | Wilson et al. | |
| 2016/0073855 | A1 | 3/2016 | Farr et al. | |
| 2016/0162747 | A1* | 6/2016 | Singh | G06K 9/00362 348/148 |
| 2017/0009956 | A1 | 1/2017 | Nichols | |
| 2019/0056498 | A1* | 2/2019 | Sonn | G01S 17/931 |

* cited by examiner

SYSTEM FOR DETECTING THE PRESENCE OF AN OBJECT TO BE PROTECTED IN A LOW-LIGHT ENVIRONMENT

BACKGROUND OF THE INVENTION

Field of the Invention

The present invention relates to lights and tracking systems for use in low light environments such as underground mines. More specifically, the present invention relates to lights using visible and ultraviolet light to illuminate unique markings associated with certain assets and a system for identifying and tracking those assets.

Description of the Related Art

Low light conditions present a hazard to underground mine workers and the like who work in close proximity to large industrial machinery. To increase visibility, such workers are often outfitted personal protective equipment such as reflective or high visibility colored clothing. The introduction of LED lighting technology has reduced much of the ultraviolet (UV) radiation emitted from an artificial light source to near zero. While the efficiency of the LED lighting is very desirable, its use alters the spectral breadth of the light being produced. The lack of ultraviolet light degrades the effectiveness of safety markings placed on equipment and the clothing and safety equipment worn by personnel, in that many of such markings are designed to fluoresce, which requires the presence of UV spectral power.

Ultraviolet light is an electromagnetic radiation with a wavelength from roughly 10 nm (30 PHz) to 380 nm (750 THz), which is a shorter wavelength than that of visible light but longer than X-rays. UV radiation is present in sunlight, and also produced by electric arcs and specialized lights such as mercury-vapor lamps, tanning lamps, and black lights. Although the UV light lacks the energy to ionize atoms, long-wavelength ultraviolet radiation can influence chemical reactions, and causes many substances to glow or fluoresce.

In certain situations, it is often advantageous to be able to identify certain objects and distinguish them from other objects in low light conditions. For example, different actions may need to be taken if an underground mining machine identifies a person in its field of view as opposed to another machine in that same field of view. It may also be beneficial to track assets that are identified as being in the proximity of a particular machine in an underground mine.

Accordingly, there is a need for a lighting unit for use in low light areas that emits visible light and ultraviolet light to improve the fluorescing of reflectors in low light conditions. There is also a need for a system using such a lighting unit that can identify and track objects in low light conditions and differentiate objects from other objects.

SUMMARY OF THE INVENTION

It is therefore an object of the present invention to provide a lighting unit for use in low lighting areas that transmits light in the ultraviolet spectrum in a broad area while simultaneously transmitting visual light in a focused beam.

It is also an object of the invention to provide a system for detecting patterns on objects having reflective or high visibility colored material thereon through the use of an improved lighting unit as described above in conjunction with a camera, controller/processor, warning devices and specific patterns of fluorescent or high visibility markings on objects to distinguish them from other objects.

The present invention meets these objects by providing an improved lighting unit having ultraviolet light emitters that transmit UV light without the use of a lens to direct or focus the light while simultaneously emitting visual light from visual light emitters through a lens which directs and focuses the visual light. Further, the present invention meets these objects by providing a system for detecting patterns on objects having reflective or high visibility colored material thereon using the light unit described in conjunction with a camera, controller, and warning device to differentiate objects from one another.

According to one presently preferred embodiment of the invention, there is provided a lighting unit for use in an underground mine comprising a main housing, a first visual light assembly and a second ultraviolet light assembly. The main housing includes a front opening and a cavity. The first visual lighting assembly is positioned within the cavity of the main housing and includes a first visual light emitter that emits light in the visible spectrum. The second ultraviolet lighting assembly is positioned a fixed distance from the first visual lighting assembly within the cavity of the main housing and includes a second ultraviolet light emitter that emits light in the ultraviolet spectrum. A spacer ring may be located between the first and second lighting assemblies. The first visual lighting assembly may further include a visual light printed circuit board having one or more visible light emitters, which may be light emitting diodes, located thereon. The second ultraviolet lighting assembly may include a separate UV light printed circuit board having one or more UV light emitters located thereon. The UV light printed circuit board may further include one or more openings therein corresponding to and aligned with the one or more visible light emitters to allow the visual light emitted from the visible light emitters to project from the front of the lighting unit. One or more lenses corresponding to and positioned within the one or more openings may also be provided to focus and direct the visual light emitted by the one or more visual light emitters.

According to an alternative embodiment of the present invention, there is provided a lighting unit for use in an underground mine comprising a main housing, a visual and ultraviolet lighting assembly and a lens. The main housing includes a front opening and a cavity. The visual and ultraviolet lighting assembly is positioned within the cavity of the main housing and includes a first visual light emitter that emits light in the visible spectrum and a second ultraviolet light emitter that emits light in the ultraviolet spectrum. The lens is positioned at the front opening of the main housing and includes means for transmitting both the visual and ultraviolet light emitted from the lighting assembly. The visual and ultraviolet lighting assembly may include a plurality of visible light emitters and a plurality of ultraviolet light emitters. The lens may be configured to magnify and direct the visual light at a desired beam. A plurality of light pipes are provided in the lens, each light pipe being aligned with a corresponding one of the plurality of ultraviolet light emitters for transmitting the ultraviolet light from the housing without magnification or beam expansion. The lens may be formed from a silicone material and the light pipes may be formed of an acrylic material embedded in the silicone lens. A driver printed circuit board may be provided and is electrically coupled to the visible light printed circuit board and the ultraviolet light printed circuit board to transmit data, information and/or power to the printed circuit boards, visible light emitters, and ultraviolet light emitters. The driver printed circuit board is preferably located in a rear opening of the main housing.

According to yet another embodiment of the present invention, there is provided a system for detecting reflective patterns on objects such as safety vests and mining helmets comprising a lighting unit, a camera, a warning device, a controller/processor, means for transmitting a signal and means for distinguishing and differentiating patterns on the objects. The lighting unit comprises a main housing having a front opening and a cavity, a first visual lighting assembly positioned within the cavity of the main housing and having a first visual light emitter that emits light in the visible spectrum, and a second ultraviolet lighting assembly positioned a fixed distance from the first visual lighting assembly within the cavity of the main housing and having a second ultraviolet light emitter that emits light in the ultraviolet spectrum. The camera has a field of view within which the system is configured to detect patterns of reflective material on one or more objects. The warning device is configured to alert the operator when one of the one or more objects enters the camera's field of view. The controller/processor is programmed to detect when a pattern of reflective material enters the camera's field of view. Means for transmitting a signal from the controller/processor to the warning device, and means for distinguishing and differentiating patterns of reflective material on each of said one or more objects are also provided in accordance with this embodiment of the invention. A display for displaying images from the camera may also be provided. The controller/processor is programmed to recognize and learn different patterns of reflective material, and different patterns are associated with different objects. The camera may be equipped with infrared lighting to assist in detecting objects in low or no light conditions. The display is preferably a high-definition digital color display which aids in viewing the patterns of reflective material.

These and other objects, features and advantages of the present invention will become apparent from a review of the following drawings and detailed description of the preferred embodiments of the invention.

BRIEF DESCRIPTION OF THE DRAWINGS

The present invention can best be understood in connection with the accompanying drawings. It is noted that the invention is not limited to the precise embodiments shown in the drawings, in which.

DETAILED DESCRIPTION OF THE INVENTION

Figure 1:
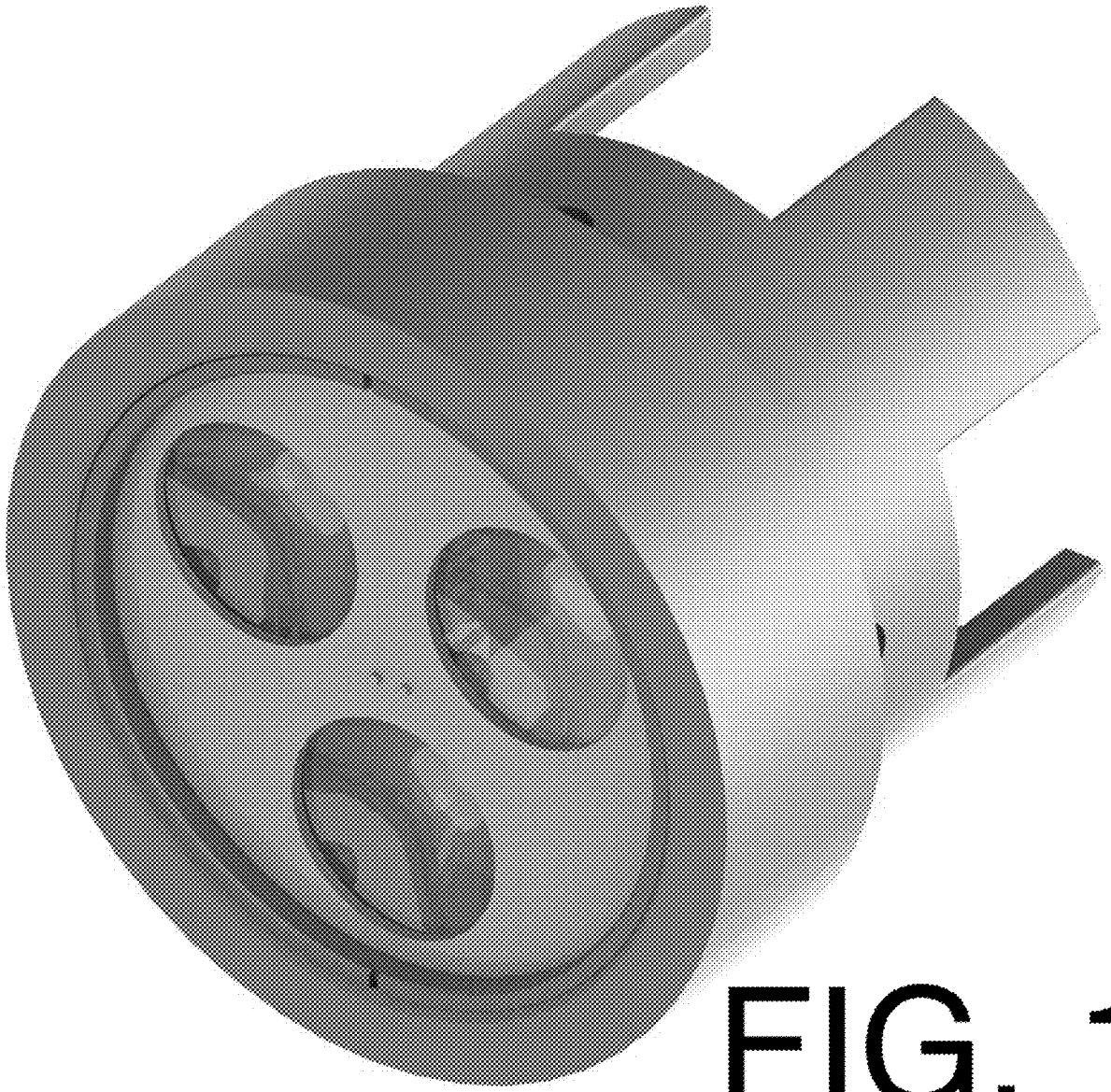
FIG. 1 is a perspective view of an assembled light unit for underground mining according to a preferred embodiment of the present invention.

For purposes of promoting and understanding of the principles of the invention, reference will now be made to the embodiments illustrated in the drawings and specific language will be used to describe the same. It will nevertheless be understood that no limitation of the scope of the invention is thereby intended. The invention includes any alterations and further modifications in the illustrated devices and described methods and further applications of the principles of the invention that would normally occur to one skilled in the art to which the invention relates.

Figure 2:
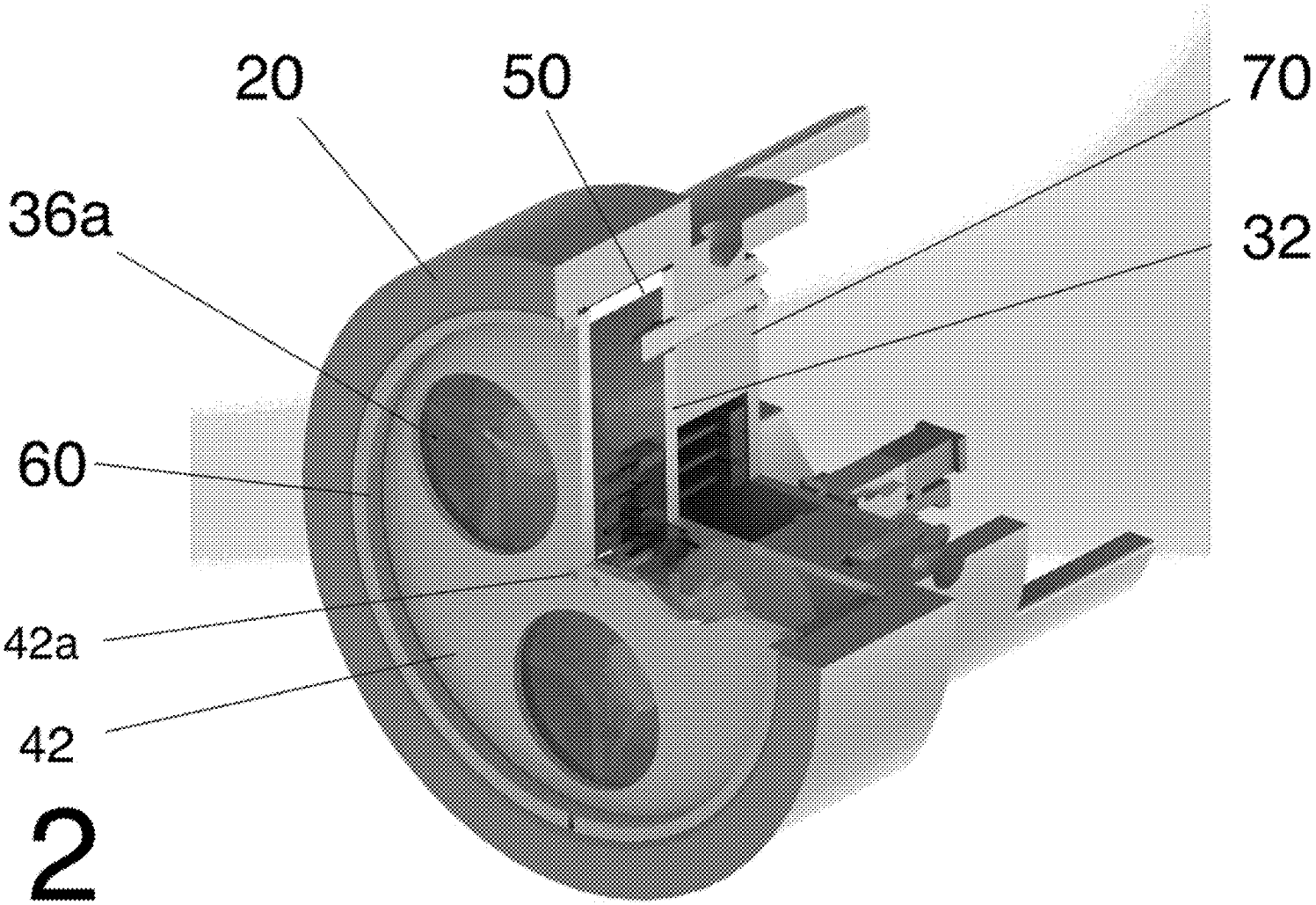
FIG. 2 is a perspective view of the light unit shown in FIG. 1 with a section cutaway to show the internal components.
Figure 3:
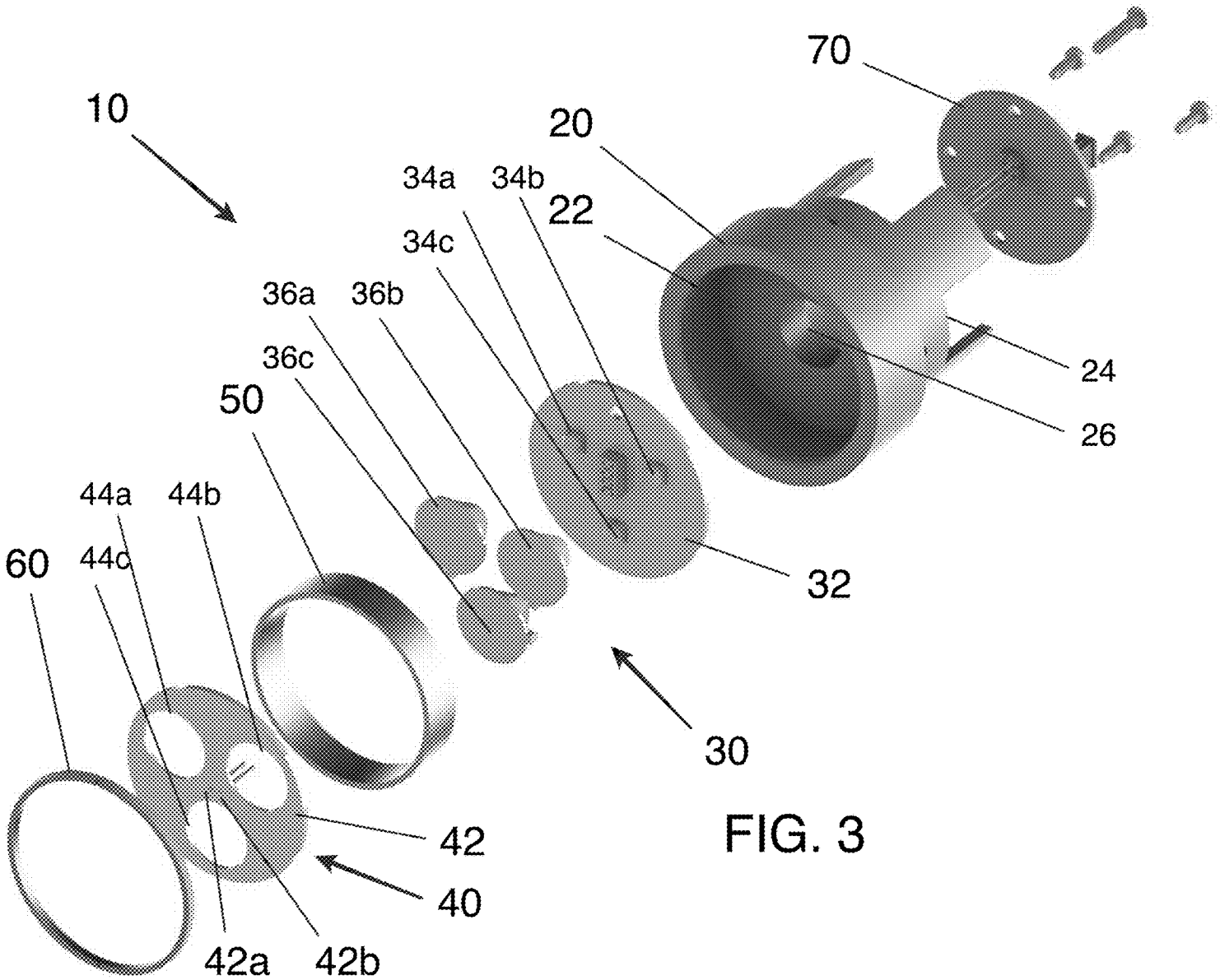
FIG. 3 is an exploded view of the light unit shown in FIG. 1 and FIG. 2.

As best shown in FIG. 1-FIG. 3, one presently preferred embodiment of the invention comprises a lighting unit 10 that is particularly suited for use in an underground mine. The lighting unit 10 includes a main housing 20 which includes a front opening or cavity 22 that is configured to receive the lights and printed circuit boards of the lighting unit 10. A first visual lighting assembly 30 is located in the front opening 22 and is configured to emit light in the visible spectrum (wavelength between 400 nm and 750 nm). A second ultraviolet (UV) lighting assembly 40 is also located in the front opening 22 and is configured to emit light in the ultraviolet (UV) spectrum (wavelength between 200 nm and 400 nm). The visible lighting assembly 30 and ultraviolet lighting assembly 40 are preferably spaced a fixed distance apart by spacer 50 which is positioned in the front opening 22 between the visible lighting assembly 30 and the the UV lighting assembly 40. A retaining ring 60 may be used to secure the visible lighting assembly 30, UV lighting assembly 40 and spacer 50 in the front opening 22 of the housing 20.

According to a preferred embodiment of the invention, the visual lighting assembly 30 includes a visual light printed circuit board 32 upon which a plurality of visible light emitters 34*a*, 34*b*, 34*c* are located. While FIGS. 1-3 depict three (3) visible light emitters, it is within the scope of the present invention to provide only one or more such light emitters. Also, according to the preferred embodiment shown in FIGS. 1-3, the visible light emitters are light emitting diodes (LEDs) 34*a*, 34*b*, 34*c* located on the visual light printed circuit board 32. In order to focus and/or direct the visual light emitted by the LEDs 34*a*, 34*b*, 34*c*, lenses 36*a*, 36*b*, 36*c* are provided. According to the preferred embodiment, a lens is associated with each LED light emitter. It is likewise within the scope of the invention to provide a single lens to focus and/or direct the visual light emitted from the LEDs.

The UV lighting assembly 40 according to the preferred embodiment shown in FIGS. 1-3 includes a separate UV light printed circuit board 42 upon which one or more UV light emitters 42*a*, 42*b* are located. A plurality of openings 44*a*, 44*b*, 44*c* corresponding to the plurality of lenses 36*a*, 36*b*, 36*c* are provided in the surface of the UV light printed circuit board 42 to accommodate the lenses and to allow the visual light emitted from the visible light emitters to project from the front of the lighting unit 10. Although the preferred embodiment shows the UV light emitters 42*a*, 42*b* on a PCB 42 that is separate from the PCB 32 on which the visible light emitters 34*a*, 34*b*, 34*c* are located, it is within the scope of the present invention to locate the UV light emitters 42*a*, 42*b* and the visible light emitters 34*a*, 34*b*, 34*c* on the same PCB.

A driver printed circuit board 70 is also provided according to the preferred embodiment of the invention. The driver PCB 70 is electrically coupled to the visible light PCB 32 and UV light PCB 42 to transmit data, information and/or power to the PCBs and visible light emitters 34*a*, 34*b*, 34*c* and UV light emitters 42*a*, 42*b*. According to the preferred embodiment shown in FIGS. 1-3, the driver PCB 70 is located in a rear opening or cavity 24 of the main housing 20 and electrically communicates with the visible light PCB 32 and UV light PCB 42 through pins 72 that extend through an opening 26 in the main housing 20. It is also within the scope of the present invention to position the driver PCB 70 in the front opening 22 of the main housing 20.

Power is supplied to the visible light PCB 32 and UV light PCB 42 via the driver PCB 70. According to a further embodiment or aspect of the invention, an AC-DC converter PCB (not shown) is utilized to accommodate AC voltage specifications (6 VAC at present). According to this aspect of the invention, the converter PCB would be installed in the rear cavity 24 of the housing 22 above the driver PCB 70.

Figure 4:
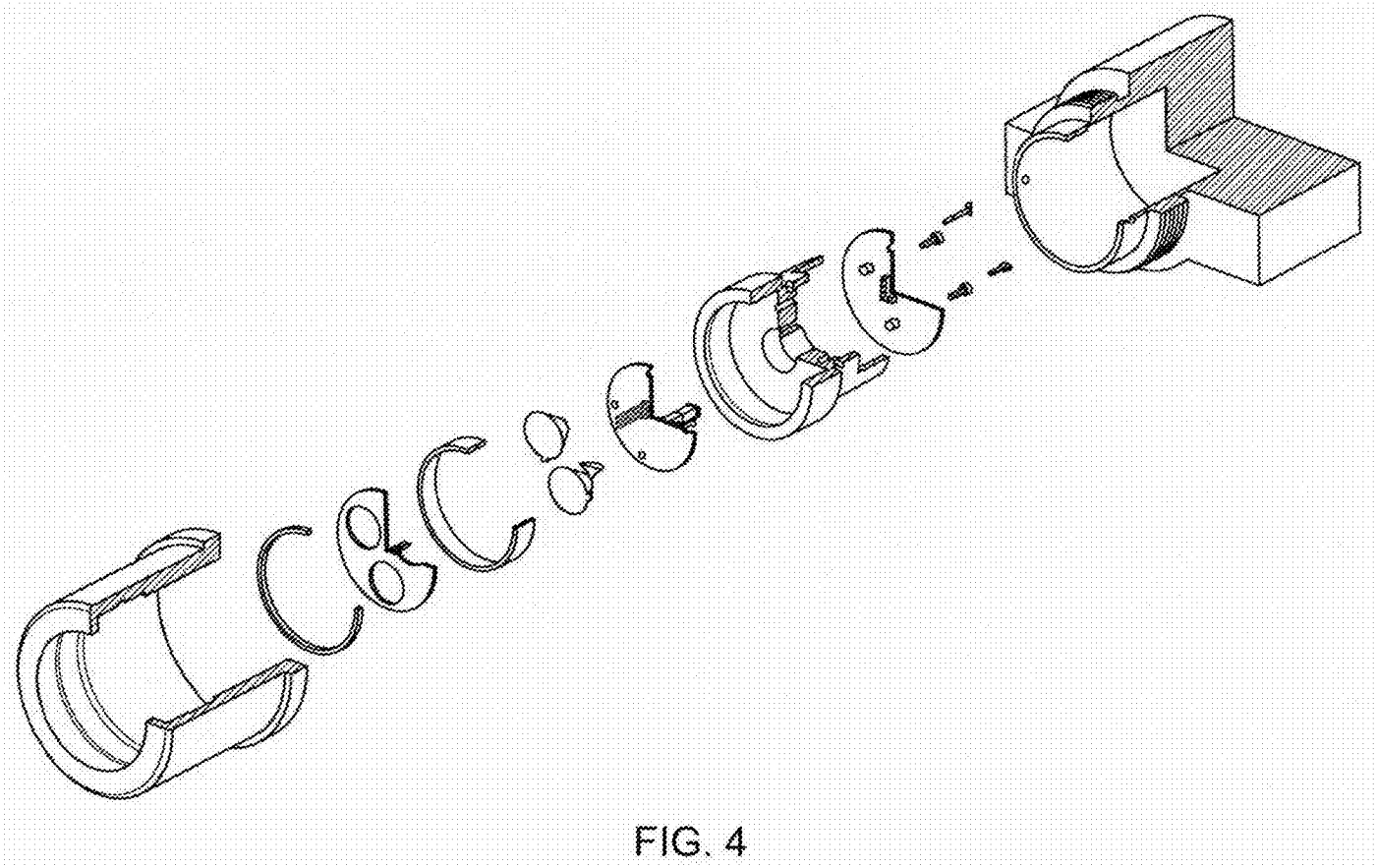
FIG. 4 is an exploded cutaway view of the light unit shown in FIG. 1-FIG. 3 with an external housing.
Figure 5:
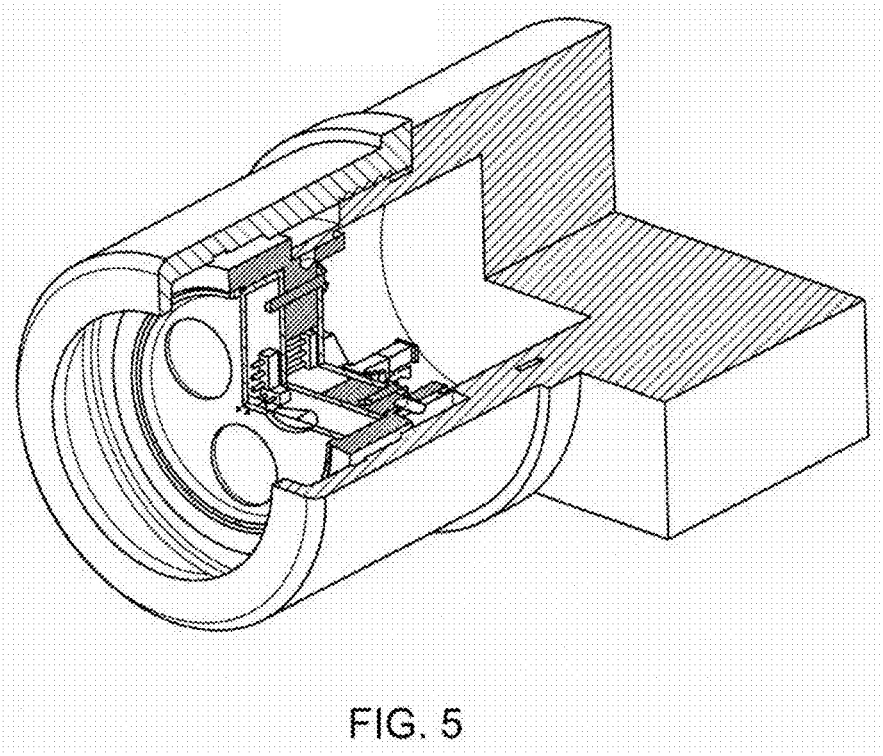
FIG. 5 is a cutaway view of the light unit and external housing shown in FIG. 4.
Figure 9:
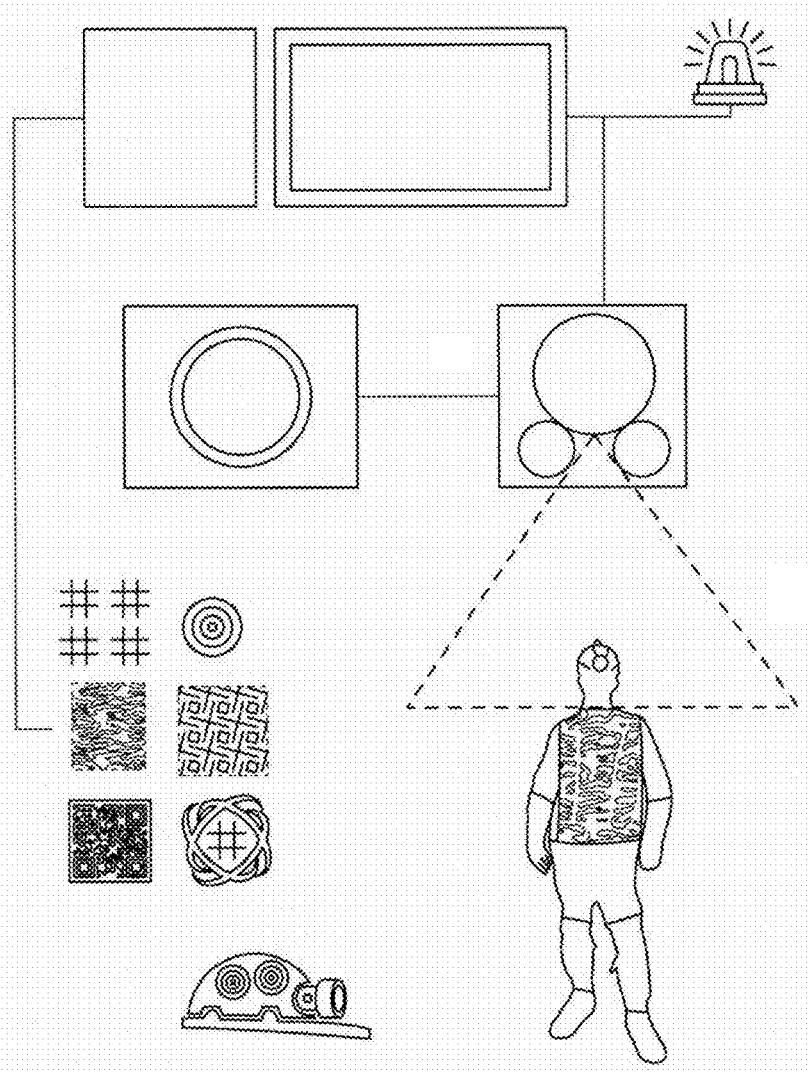
FIG. 9 is a block diagram of a system for detecting reflective patterns on objects using the light unit of the present invention.

As best shown in FIGS. 4-5, the lighting unit 10 may be located in an external housing 80. According to a preferred embodiment, the external housing includes first and second housing members 80*a*, 80*b* which are threadabtly connected to one another to hold the lighting unit 10 in place. The external housing 80 is preferrably mounted to an underground mining machine or other piece of equipment that could benefit from illumination by the lighting unit 10. When mounted to such a piece of underground mining machinery, the lighting unit 10 can be used in conjunction with a system for detecting reflective patterns on objects as is shown in FIG. 9 and discussed more fully below. Alternatively, the lighting unit 10 may be adapted for mounting to the helmet of a miner.

Figure 6:
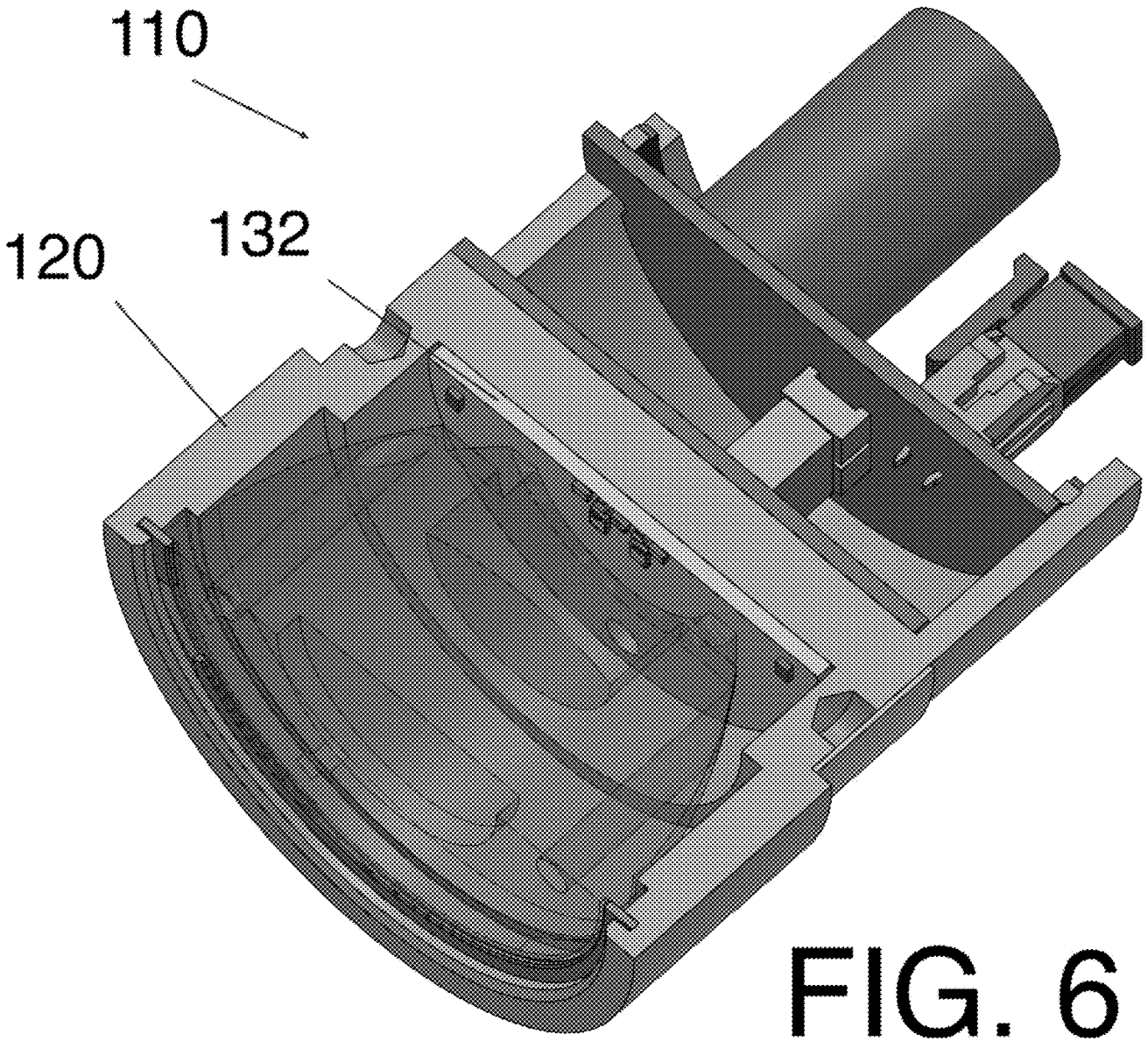
FIG. 6 is cutaway perspective view of a light unit according to an alternative preferred embodiment of the present invention.
Figure 7:
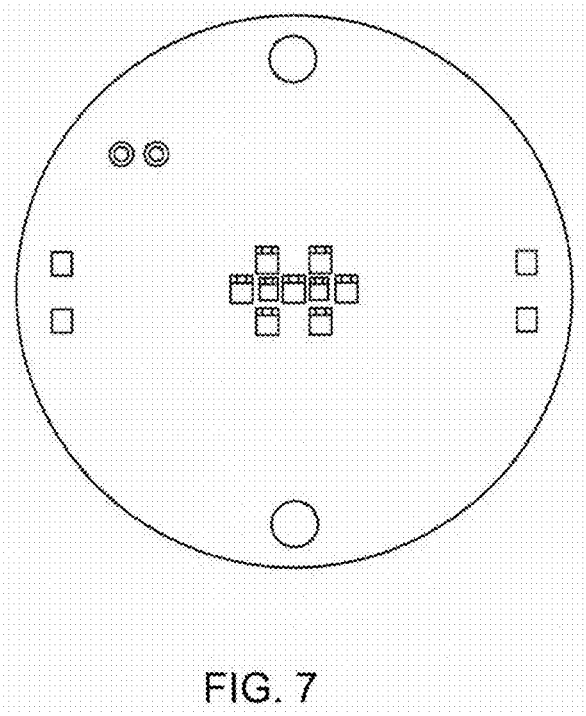
FIG. 7 is a front plan view of the printed circuit board and lighting elements of the lighting unit shown in FIG. 6.
Figure 8:
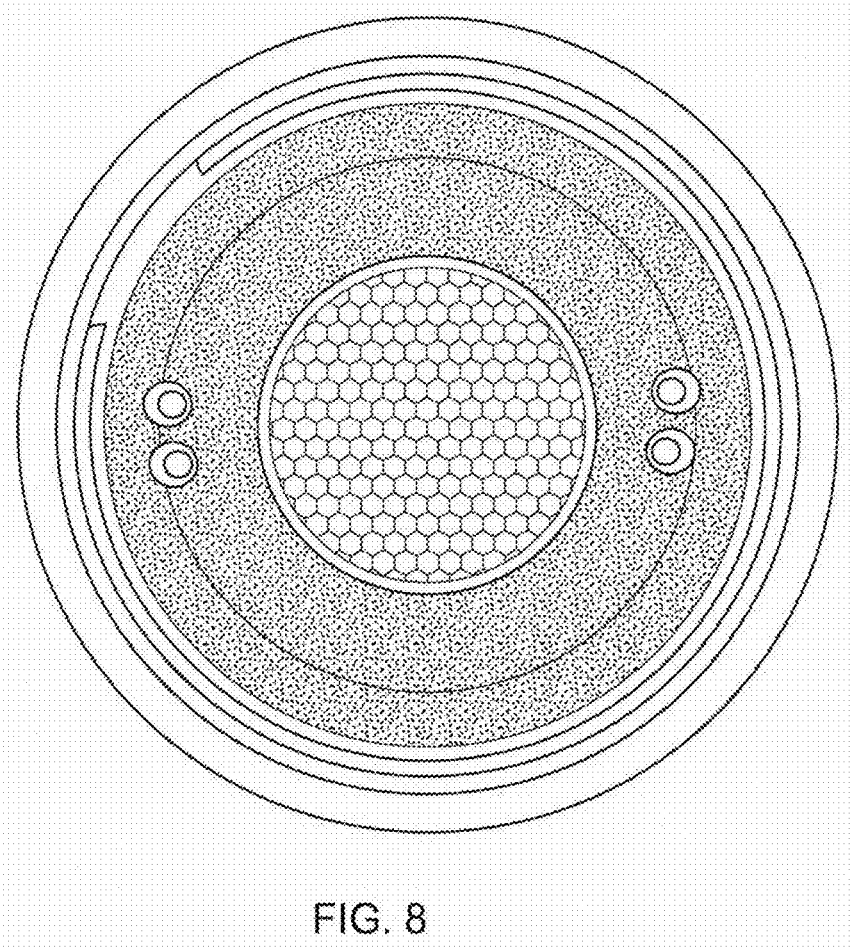
FIG. 8 is a front plan view of the lighting unit shown in FIG. 6 showing the lens.

An alternative embodiment of a lighting unit 110 is shown in FIG. 6-FIG. 8, wherein like reference numerals indicate like components. The primary differences between the lighting unit 110 of FIG. 6-FIG. 8 and the lighting unit 10 of FIG. 1-FIG. 6 is the presence of only a single printed circuit board 132 which carries both a plurality of visual light emitters 134*a*-134*i*, and a plurality of UV light emitters 144*a*, 144*b*, 144*c*, 144*d*. The lighting unit 110 includes a main housing 120 which includes a front opening or cavity 122 that is configured to receive the lights and printed circuit board 132 of the lighting unit 110. The printed circuit board 132 is located in the front opening 122 and is configured to emit light in the visible spectrum (wavelength between 400 nm and 750 nm) and light in the ultraviolet (UV) spectrum (wavelength between 200 nm and 400 nm). Again, while FIG. 7 depict nine (9) visible light emitters 134 and four (4) UV light emitters 144, it is within the scope of the present invention to provide only one or more such light emitters.

According to the embodiment shown in FIG. 7, different colored visible light emitters can be used to accomplish different purposes. For example, visual light emitters 134*a*, 134*b*, 134*c*, 134*b* can emit white visual light to illuminate areas to improve visibility for the operator of a piece of machinery, while visual light emitters 134*e*, 134*f*, 134*g* may emit red visual light. In this way, light units can be mounted on both the front and back of a vehicle that may have need to travel frequently in forward and reverse. A controller associated with the vehicle can be programmed such that the white lights emitters are illuminated when the vehicle is traveling in the direction while the red light emitters may be illuminated on the rear end of the vehicle relative to the direction of travel, essentially functioning as tail lights. When the vehicle reverse directions, either the operator, or the controller switches the red lights on what is now the leading end of the vehicle to white lights and the white lights on what is now the trailing end of the vehicle to red lights. Further, light blue visual light emitters 134*h*, 134*i* may also be provided and work in conjunction with the white light emitters to improve visual contrast of illuminated objects.

As best shown in FIG. 8, In order to focus and/or direct the visual light emitted by the LEDs 134*a*, 134*b*, 134*c*, a lens 136 is provided. According to the preferred embodiment shown in FIG. 8, a single lens 136 is provided to transmit and direct both the visual light and UV light. Acrylic light pipes 137*a*, 137*b*, 137*c*, 137*d* are embedded in the lens 136, which is preferably formed of silcone, over each UV LED 144*a*, 144*b*, 144*c*, 144*d*. The light pipes 137*a*, 137*b*, 137*c*, 137*d* just transmit the UV to the front surface without any magnification or beam expansion. The beam angle is limited by the window opening in the housing 120. Alternatively, custom lens designs may be utilized wherein there will be an inner lens for the white LED's and either a concentric outer lens that transmits the UV, or 2 smaller individual lenses for the UV. The key to lens design and configuration is to provide as wide a UV beam as possible within the packaging constraints.

As shown in FIG. 9, the lighting unit 210 is an integral part of a system 200 for detecting reflective patterns on objects such as safety vests 310 and mining helmets 320. The system 200 includes the lighting unit 210 as described in the embodiments above, a camera 220, which has a field of view within which the system of the present invention is configured to detect patterns of reflective material on items such as clothing 310 or helmets 320. The camera 220 may be equipped with infrared lighting 222 to assist in detecting objects in low or no light conditions. The system 200 also includes a display 240 for displaying images from the camera 220. Preferably, the display 240 is a high-definition digital color display which aids in viewing the patterns of reflective material. A visual and/or audible warning device 250 may also be provided to alert the operator when an object carrying a pattern of reflective material enters the camera's field of view. A controller/processor 230 is also provided. The controller/processor 230 is programmed to detect when a pattern of reflective material enters the camera's field of view. The controller/processor 230 may then send a signal to the warning device 250 which issues a warning to the operator. The controller/processor 230 may also be programmed to recognize and learn different patterns of reflective material such as those shown in FIG. 9. The different patterns may be associated with different objects, such as the camouflage pattern shown in FIG. 9 associated with a worker safety vest 310 or the bullseye pattern associated with a mining helmet 320. The controller/processor 230 may be programmed to learn the different patterns, associate those patterns with particular objects, and respond in an appropriate manner given the nature of the object.

This detailed description, and particularly the specific details of the exemplary embodiment disclosed, is given primarily for clearness of understanding and no unnecessary limitations are to be understood therefrom, for modifications will become evident to those skilled in the art upon reading this disclosure and may be made without departing from the spirit or scope of the claimed invention.

We claim:

1. A system for detecting the presence of an object to be protected in a low-light environment comprising:

a target configured for placement on the object, said target having a distinctive pattern and comprised of high-visibility material;

a lighting unit comprising a main housing having a front opening and a cavity; a first visual lighting assembly positioned within the cavity of the main housing, said first visual lighting assembly having a first visual light emitter that emits light in the visible spectrum; and a second ultraviolet lighting assembly positioned within the cavity of the main housing, said second ultraviolet lighting assembly having a second ultraviolet light emitter that emits light in the ultraviolet spectrum;

wherein the lighting unit further comprises an opening corresponding to and aligned with said first visual light emitter to allow the visual light emitted from the visual light emitter to project from the front of the lighting unit;

a camera having a field of view within which the system is configured to detect said distinctive pattern;

a warning device to alert the operator when said target enters the camera's field of view;

a controller/processor programmed to detect when a said distinctive pattern enters the camera's field of view;

means for transmitting a signal from said controller/processor to said warning device; and means for distinguishing and associating said distinctive pattern with a particular object.

2. The system for detecting the presence of an object to be protected in a low-light environment according to claim 1, further comprising a display for displaying images from the camera.

3. The system for detecting the presence of an object to be protected in a low-light environment according to claim 2 wherein the controller/processor is programmed to recognize and learn different distinctive patterns of reflective or high visibility colored material.

4. The system of claim 1 wherein a plurality of distinctive patterns are associated with a corresponding plurality of different objects.

5. The system of claim 1 wherein the camera is equipped with infrared lighting to assist in detecting objects in low or no light conditions.

6. The system of claim 2 wherein the display is a high-definition digital color display which aids in viewing the distinctive patterns.

* * * * *